United States Patent [19]

Stone

[11] 4,033,863

[45] July 5, 1977

[54] APPARATUS FOR SEPARATING HIGH GRAVITY FROM LOW GRAVITY FRACTIONS OF A COAL OR AN ORE

[75] Inventor: Spencer A. Stone, Fort Wayne, Ind.

[73] Assignee: Deister Concentrator Company Inc., Fort Wayne, Ind.

[22] Filed: Dec. 19, 1975

[21] Appl. No.: 642,453

[52] U.S. Cl. ..... 209/159; 209/496; 222/64; 251/63.6

[51] Int. Cl.[2] ..... B03B 5/66

[58] Field of Search ..... 209/158–161, 209/208, 211, 491, 496; 222/64; 251/62, 63.5, 63.6

[56] References Cited

UNITED STATES PATENTS

| | | | |
|---|---|---|---|
| 727,974 | 5/1903 | Klein | 209/159 X |
| 1,147,356 | 7/1915 | Allen | 209/160 |
| 2,696,298 | 12/1954 | Griffin | 209/159 |
| 2,922,521 | 1/1960 | Schranz | 209/18 X |
| 3,160,321 | 12/1964 | Cochran | 222/64 |
| 3,410,304 | 11/1968 | Paul | 251/63.5 X |
| 3,412,858 | 11/1968 | Stone | 209/159 |

*Primary Examiner*—Frank W. Lutter
*Assistant Examiner*—Ralph J. Hill
*Attorney, Agent, or Firm*—Gust, Irish, Jeffers & Rickert

[57] ABSTRACT

Mineral separating apparatus comprises a hydraulic classifier provided with an exterior wall, an open bottom sorting column within said exterior wall, and means for introducing a swirl of hydraulic medium in the sorting column. The exterior wall provides a quiescent zone between the bottom of the sorting column and further has a spigot connected to the quiescent zone for discharge of refuse. A launder section is disposed above said exterior wall and sorting column and is in communication therewith. First and second weirs in said launder section are located on opposite sides, respectively, of said exterior wall. The first weir is higher than the second weir to provide a hydraulic flow gradient therebetween. A feed box in the launder section is separated from the exterior wall of the classifier by the first weir and a discharge spout for the launder section is located on the side opposite the second weir, whereby overflow of hydraulic medium from the first weir and sorting column passes over the second weir and out of said discharge spout.

Automatically controlled valve means is operatively associated with the spigot for maintaining the bed level in the quiescent zone at a predetermined height. Feed pulp mixed with water entering the feed box overflows the first and second weirs and also enters the region of the sorting column such that it undergoes conjoint stream and hydraulic classification before being discharged from the discharge spout.

10 Claims, 5 Drawing Figures

FIG. I

APPARATUS FOR SEPARATING HIGH GRAVITY FROM LOW GRAVITY FRACTIONS OF A COAL OR AN ORE

BACKGROUND OF THE INVENTION

1. Field of the Invention

The present invention relates generally to mineral separation and more particularly to the control and automation of hydraulic classifiers of the general type shown in U.S. Pat. Nos. 2,696,298, 2,681,751 and 3,412,858, for efficiently separating rock from raw coal prior to delivery to cleaning devices such as Coal-washing tables.

2. Description of the Prior Art

The aforesaid patents relate to hydraulic classifiers wherein the spigot discharge from the classifier constitutes the feed to an ore-concentrating or coal-washing table, both of which require a reasonably constant rate of feed in order to function in a desired, optimum manner.

Under conditions currently prevailing in the coal industry wherein poorer grades and thinner seams of coal are being mined, the percentage of shale, rock and reject material contained in the run-of-the-mine coal is markedly increased in many instances. The higher percentage of rejects in total plant feed and particularly in the smaller size fractions that would be cleaned on coal-washing tables or similar cleaning devices, limits and reduces the overall capacity of the equipment and the plant as a whole. The ultimate capacity is determined either by the quantity of reject material that the equipment can separate and discharge as a separate product or by rated feed capacity of the equipment, whichever occurs first. Thus, a plant with a rated feed capacity of 250 tons per hour or 62½ tons per hour of rejects, such rejects constituting 25% of the feed, would function satisfactorilly at the 250 tons per hour rate. If, however, the percentage of rejects is increased to 30%, plant feed would have to be reduced to 208 tons per hour; at 40%, it would need to be reduced to only 156 tons per hour and at 50% to only 125 tons per hour. However, if the percentages of rejects is only 20% or less, the plant capacity would still be only 250 tons per hour.

It is therefore evident that plant capacities can be enhanced and/or maintained at normal feed rates when handling feeds containing excess rejects, if a portion of such excess could be inexpensively stripped out of the raw coal feed ahead of the tables. This can be best done by hydraulic classification but not with classifiers as described in the aforementioned patents.

In these prior art classifiers, the incoming feed after passing over the first cell goes on to the following cells in series where each classifies and discharges succeedingly smaller size particles according to their settling rates in water. Only the first cell, or in some rare cases the first and second cells, can separate coarse size, high gravity refuse material from desirable coal as those familiar with he classification art are well aware. Thereafter, each succeeding cell will discharge as its spigot product, a mixture of particles composed of coarser sizes of light gravity material and relatively finer sizes of higher gravity particles having exactly the same settling rates in water. The varients in the size range of particles in any spigot will be a function of the differential in specific gravity between the materials.

Thus, the first cell is the only cell of value in stripping out refuse to obtain a clean product. However, since there is a mechanical limitation on the diameter of the sorting column, and hence on the size of the cell itself, as disclosed in U.S. Pat. No. 2,696,298, and since any sizeable plant would thus require more than the single cell unit to handle required capacity, multiple units having a series of cells would be indicated rather than installing a battery of single cells in parallel in accordance with the present invention. In a unit of this invention wherein the multiple cells are in parallel, the launder section above the cells is so designed as to permit transverse flow with each feed stream passing over one cell only, instead of one larger stream flowing lengthwise over a plurality of cells ranged in series.

Since the spigot discharge of each cell is not required to be treated on a table and can go directly to waste, the discharge from the cell can be intermittent and the elaborate and costly controls used on the prior art, series type, high capacity classifiers will not be required.

SUMMARY OF THE INVENTION

This invention relates to apparatus for separating rock from raw coal wherein the classifier is hydraulic and is provided with an exterior wall and an open bottom sorting column within the wall. Means are provided for introducing a swirl of water or hydraulic medium in the sorting column, the exterior wall providing a conically shaped quiescent zone below the bottom of the sorting column, this quiescent zone being provided with a spigot from which refuse may be discharged. During operation, a bead of refuse is maintained at a predetermined height in the quiescent zone to assure proper swirling action within the sorting column.

To assure high capacity discharge of product, the apparatus of this invention utilizes a launder section above the exterior wall and sorting column. First and second weirs in the launder section are disposed on opposite sides, respectively, of the exterior wall. The first weir is higher than the second weir, and is separated from the exterior wall of the classifier by means of a feed box in the launder section. The second weir adjoins the discharge spout from the launder section located on the side opposite the first weir thereby to provide a hydraulic flow gradient from the first weir to the second weir.

Valve means is operatively associated with the spigot for maintaining the bed level in said quiescent zone at a predetermined height, this height control being obtained automatically. Feed pulp thus entering the feed box, overflowing the first and second weirs and also entering the sorting column undergoes conjoint stream and hydraulic classification before being discharged from the spout of the launder section. Refuse is discharged from the spigot intermittently but controlled to maintain the bed level such that the product flowing from the launder section has excess refuse separated therefrom. The product from the launder section is then delivered to the coal-washing tables or cleaners in a conventional manner and continuously up to the level of maiximum feed capacity.

OBJECTS OF THIS INVENTION

One object of this invention is to provide a single or multiple cell, high capacity classifier capable of reducing the refuse content of raw coal feeds, or when handling minerals making a clean concentrate of the coarser but higher gravity mineral fraction devoid of the low gravity gangue minerals. Another object is to provide a simple, rugged and inexpensive apparatus for drawing off the settled solids from the quiescent bed in the bottom of the classifier cell.

A further object is to maintain the depth of the bed of settled solids within the quiescent zone of the classifier within relatively narrow limits so as to avoid disturbing the classification occurring above the bed of solids.

Yet another object is to provide a "fail-safe" means or device to assure that in the event of a power failure, the cell or classifier will remain closed to avoid being drained of water and solids. Yet another object is to provide a minimum sized classifier in relation to the maximum size sorting column that can be uitilized while maintaining stable classification conditions within the sorting column so as to provide maximum capacity discharge within minimum space requirement for an apparatus of this type.

The above-mentioned and other features and objects of this invention and the manner of attaining them will become more apparent and the invntion itself will be best understood by reference to the following description of anembodiment of the invention taken in conjunction with the accompanying drawings.

BRIEF DESCRIPTION OF THE DRAWINGS

In the drawings, drawn substantially to scale.

DESCRIPTION OF THE PREFERRED EMBODIMENT

Figure 1:
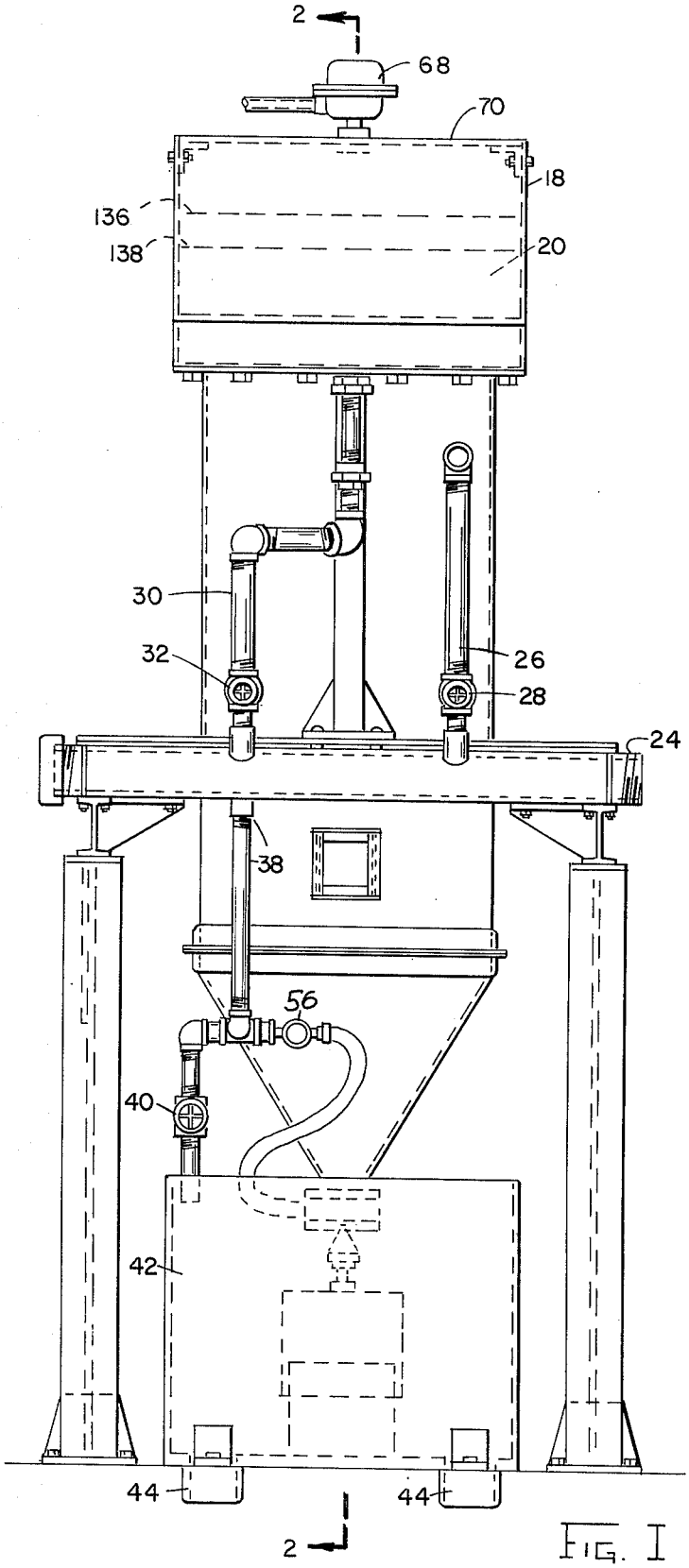
FIG. 1 is a front view of one embodiment of this invention.
Figure 2:
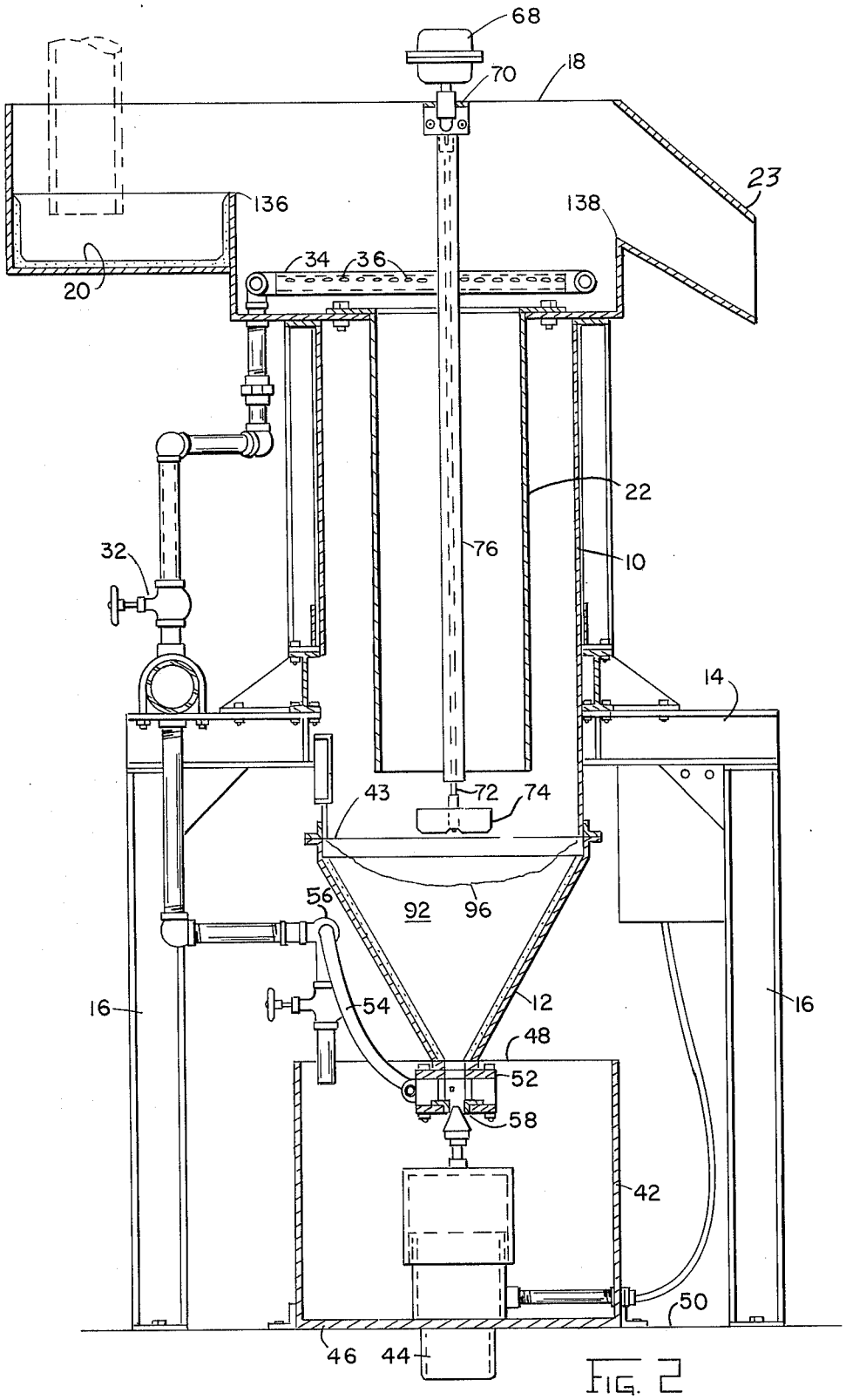
FIG. 2 is a sectional view taken substantially along section line 2—2 of FIG. 1.

Referring to FIGS. 1 and 2, a cylindrical cell corresponding to the cells disclosed in U.S. Pat. Nos. 2,696,298 and 3,412,858 including a cylindrical wall 10 which terminates in a conical section 12 at its lower end. The wall 10 and section 12 are supported on main frame members 14 and legs 16. Above the cylindrical wall 10 and bolted thereto is launder section 18 having a feed box 20 at the left (as viewed in FIG. 2) and an overflow spout 22 at the right. Within the cylindrical wall 10 and bolted to the bottom of launder section 18 is a sorting column 22 having a diameter calculated to be of maximum size permissible according to the size and specific gravity of the largest particles in the feed pulp and the tonage that should be delivered.

A water header pipe 24 has leading therefrom a pipe 26, provided with a regulating valve 28, which rises and enters into the classifier tangentially near the top thereof, as in the aforesaid patents, from which point the water spirals downwardly in the annular space between the wall 10 and sorting column 22 to enter the bottom of the sorting column and rises through it in an upward spiral.

Another pipe 30 provided with a hand operated valve 32 leads from the header pipe 24 to a closed loop of pipe 34 (FIG. 2) which, in this instance, is rectangular. The pipe loop 34 has a multiplicity of drilled holes 36 from which water is discharged into the launder section 18. As shown, the pipe loop 34 surrounds the upper end of the sorting column 22 thus providing additional water to the launder section 18 to the feed material traversing the latter.

Extending downwardly from the header pipe 24 is another pipe 38 having a hand operated regulating valve 40 therein for the purpose of providing flush water to the waste-receiving box 42 having one or more outlets 44. The waste-receiving box 42 may be either cylindrical or square having a closed bottom 46 and open top 48. The box 42 is mounted on a suitable supporting surface 50.

Figure 4:
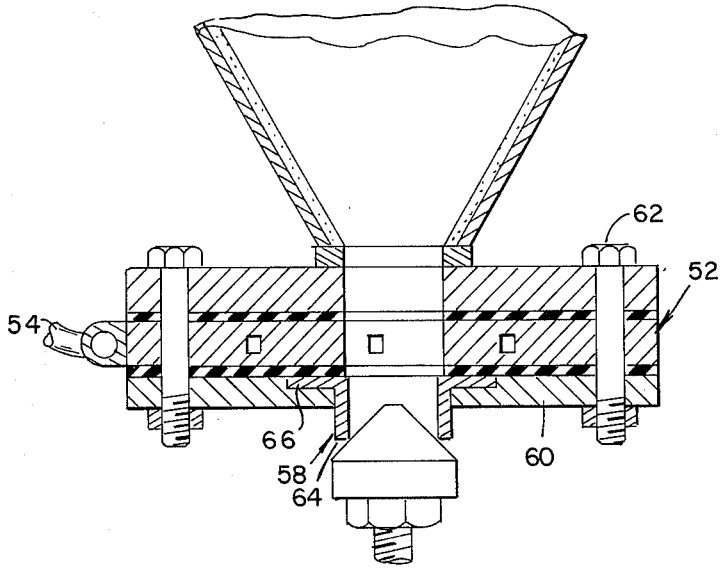
FIG. 4 is a fragmentary sectional view of the spigot and valve in closed position.

The conical section 12 terminates in a flange to which is bolted a conventional water injector fitting 52 shown in enlarged detail in FIG. 4. This fitting 52 may be of the same design as that disclosed in U.S. Pat. No. 3,412,858. This fitting 52 has a hose line 54 with a control valve 56 connected thereto which leads to the pipe 38. Water injected through the fitting 52 keeps the settled solids in the apex of the cone 12 fluid to permit discharge through the orifice bushing 58 which is held in place by a flange plate 60 to fitting 52 by means of bolts 62. The bushing 58 can have orifices of different diameters to meet the requirements of handling various rates of discharge and size of particles contained in the classifier feed.

The orifice bushing 58 is a single casting, composed of a depending tubular portion 64 and an annular flange 66. The plate 60 secures the bushing 58 to the injector fitting 52, being provided with a suitable undercut that fits over the flange 66 to provide a close fit.

At the top of the launder section 18 is mounted a bin-level measuring device indicated generally be the reference numeral 68. The device 68 is supported on a cross brace 70 attached to the sides of the launder section 18 which is generally of rectangular shape having its upper side open. The device 68 includes an electric motor having connected to the rotor thereof a long shaft 72 which terminates beneath the sorting column 22 and has mounted thereon a sensing device in the form of paddle wheel 74. The shaft 72 is encased by a protective pipe casing 76 suitably secured to the cross brace 70.

The bin-level measuring device 68 is of conventional construction and may be in the form of a leveling control sold under the name of Bin-O-Matic manufactured by Monitor Manufacturing, Inc., 200 North Island Avenue, Batavia, Illinois, and as disclosed in a copyrighted brochure dated 1971.

Figure 5:
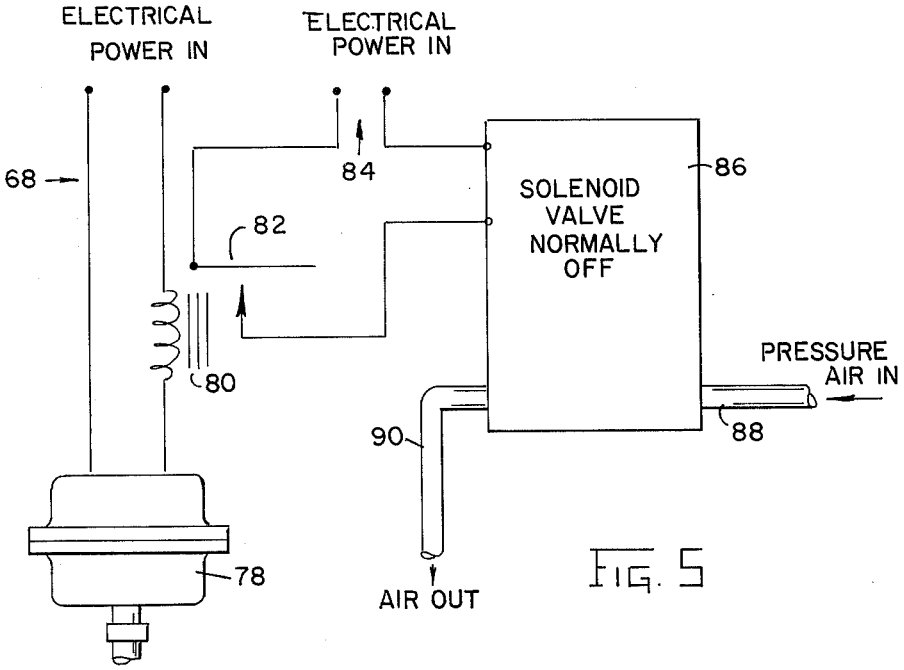
FIG. 5 is a schematic of a portion of the control circuitry employed in maintaining a fairly uniform depth of bed in the quiescent zone.

A more detailed description of a suitable bin-level measuring device is shown in FIG. 5. A small, low torque, low speed electric motor 78 has connected in series with one of the electrical power leasds a switching relay 80 having a normally open switch 82. The motor 78 is so designed that during normal, rotational operation, insufficient current is drawn to energize relay 80 whereupon the switch 82 remains open. The switch 82 therefore may be regarded as being normally open.

In series with the switch 82 is a source of electrical power 84 and an electrically operated solenoid valve 86. This solenoid valve is normally closed and is of the pneumatic type.

Again, during normal rotational operation of the motor 78, the switch 82 remains open such that the solenoid valve 86 is not energized. However, should the rotor of motor 78 stall, the additional current drawn through the power leads serves to energize the relay 80 closing switch 82. This results in energization of the solenoid valve 86 opening the valve between input and output air lines 88 and 90.

During normal operation of the classifier, a bed 92 of solids builds up in the conical section 12 (FIG. 2) to a level of, for example, 96. The motor of the bin-level measuring device 68 is energzed so as to rotate the paddle wheel 74. As the level of the bed 92 rises to a point at which it impedes or stops rotation of the paddle wheel 74, the motor in the device 68 will stall. This activates an electric switch, such as switch 82, which in turn energizes a solenoid valve, such as valve 86, thereby opening communication between the two air lines 88 and 90. Instead of using a solenoid valve 86, a bell or other signaling device may be used which will ge actuated upon closure of the switch 82. This would warn an operator that the level of the bed 92 in the conical section 12 has risen too high and needs to be lowered.

When the level of the solids in the bed 92 falls below the paddle wheel 74, the latter will again start rotating and cause the electrical switch 82 in the device 68 to open and solenoid valve 86 to close. Mechanism for maintaining the level 96 of the bed 92 substantially constant will be described later.

Figure 3:
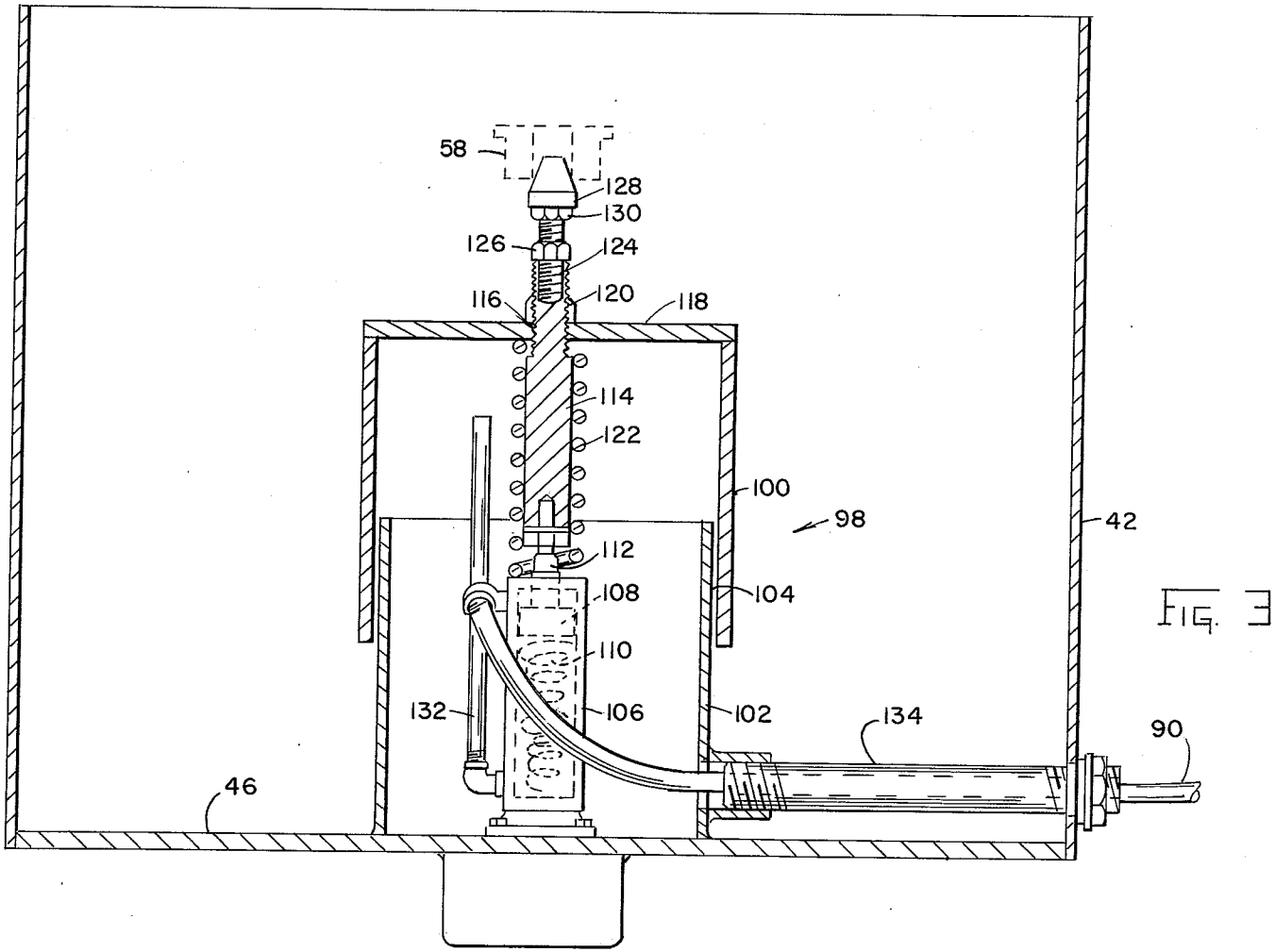
FIG. 3 is a sectional view of the valving mechanism and wastereceiving box.

Referring to FIG. 3, mechanism for controlling the discharge of refuse from the bed 92 through the injector 52 and orifice bushing 58, hereinafter referred to as the spigot 58, is shown. Disposed centrally beneath the spigot 58 is an expansible housing indicated generally by the numeral 98 which is composed of upper and lower telescoping parts 100 and 102. A slight clearance 104 is provided between the two telescoping parts 100 and 102 of a size as will become apparent from the description that follows. The housing 98 may be of any suitable shape but preferably is cylindrical.

Bolted to the bottom 46 of the waste-receiving box 42 is one end of an air cylinder 106. This air cylinder is of conventional design, including a piston 108 and an internal, helical compression spring 110 that normally holds the piston 108 protracted. A piston rod 112 connected to the piston 108 extends through the upper end of the cylinder 106 and has threaded thereon a rod extension 114 having a threaded portion 116 screwed through a companion opening in the closure 118 of the upper telescoping part 100 of the housing. A lock nut 120 threads onto the extension 116 against the closure 118 to prevent relative rotation between the closure 118 and extension 114. The extension 114 may be adjusted relative to the closure 118 by loosening the lock nut 120 and suitably rotating the extension 114.

A helical compression spring 122 surrounds the extension 114 and bears at one end against the cylinder 106 and at the other end against the closure 118. By adjusting the distance which the extension 114 projects through the closure 118, the force which the compression spring 122 exerts on the closure 118 may be altered.

Threaded into the upper end of the extension 114 is a stud 124 which is locked against rotation by means of the lock nut 126. On the upper end of the stud 124 is threaded a valve 128 shaped much like a plumb bob, a lock nut 130 securing valve 128 against rotation relative to the stud 124.

The exhaust port of the cylinder 106 has a section of pipe 132 connected thereto which terminates in the upper portion of the housing 98. The air pressure line 90 leads through a section of protective pipe 134 in the waste-receiving box 42, which extends from the wall of the latter to the housing part 102 as shown, to the upper end of the cylinder 106. Upon application of air at suitable pressure via the line 90, the piston 108 in the cylinder 106 is retracted causing lowering of the valve 128 agalinst the force of the spring 122 as well as the cylinder spring 110. Release of this air pressure will result in the two springs 110 and 122 forcing the valve 128 upwardly.

As shown in FIG. 2, and in dashed lines in FIG. 3, the valve 128 is spring held in closed position against the spigot 58 preventing flow of bed material therethrough. The amount of spring force required to maintain the valve 128 in closed position is determined by the head of water and solids above it. This spring force can be adjusted by screwing the closure 118 of the housing part 100 up or down on the extension 114 to compensate for wear that may occur on the spigot or orifice bushing 58 or of the valve 128 itself: the latter may also be adjusted on the threaded stud 124 to compensate for wear. The pipe 134 provides a water tight entry for the air hose 90. The air exhausted from the air cylinder 106 via the exhaust pipe 132 passes out of the housing 98 through the annular space 104 between the two housing sections 100 and 102. Any particles of refuse or foreign matter in the annular space 104 will thereby be ejected.

Referring to the launder section or box 18, the feed box 20 extends transversely of the launder section at 18 at the end thereof. This box 20 is separated from the classifier by a weir 136. Another weir 138 on the opposite side of the classifier is at a lower elevation than the weir 136 and communicates with the overflow spout 23 previously described.

In operation, the apparatus of this invention functions in the following manner. The hydraulic feed pulp entering the feed box 20 flows over the weir 136 into the area immediately above the sorting column 22 where it encounters water from the pipe loop 34 and the rising current from the sorting column 8 in its progress toward discharge spout 23. This assumes, of course, that water from the header 24 is passing through pipe 26 tangentially into the annular space between the sorting column 22 and the exterior wall 10. This also assumes that valve 32 is opened to provide a flow of water from the orifices 36 in the pipe loop 34. The motor of bin-leveling device 68 is energized causing rotation of paddle wheel 74.

Since the weir 138 is at a lower elevation than weir 136, there will be a hydraulic gradient causing flow toward the discharge spout 23. Both stream classification and hydraulic classification will occur with the smaller and lighter particles flowing quickly across and out of the launder section 18 while the larger and heavier particles will settle to the lowest level which would be down through the sorting column 22. By adjustment of the control valve 28, sufficient water can be admitted to the sorting column that velocity of the rising current therein will exceed the settling velocity of the largest particle of coal and the like and only the coarsest and heaviest particles of slate and refuse will settle through the column and into the conical section 12 where they accumulate in a quiescent bed or zone until the level reaches that of the paddle wheel 74. When the level of solids engages the paddle wheel 74 and stalls it, the electrical switch 82 is closed which energizes the solenoid valve 86 admitting compressed air cylinder 106. Piston 108 in the cylinder is retracted disengaging the valve 128 from the spigot or bushing 58. Under the head of water and solids, the accumulated refuse in the bed will discharge through the spigot or bushing 58 until the level of the bed is lowered to an elevation beneath the paddle wheel 74. This permits the paddle wheel 74 to resume rotation causing the motor 78 to draw less current thereby opening the switch 82 and causing closure of the solenoid valve 86. This cuts off the air supply to the cylinder 106 which results in the springs 110 and 122 returning the valve 128 into closed position in the orifice bushing 58. Discharge from the bed 92 is thus stopped and will not begin again until the level of the bed rises to the point to impede or stop rotation of the paddle wheel 74.

This invention provides a positive, simple and low cost means of controlling the rate of discharge from the classifier. Operated in the manner described, the classifier can function as a concentrating or scalping device providing a less expensive means of separating refuse from run-of-the-mine materials which are further treated on coal-washing tables or similar cleaning devices.

As explained earlier, in the coal industry wherein poorer grades and thinner seams of coal are being mined, the percentage of reject material contained therein is markedly increased in many instances. As the percentage of rejects increases in total plant feed, the capacity of coal-washing tables or similar cleaning devices become limited. By reducing the amount of rejects in such material, such coal-washing tables can be operated at maximum capacity.

By use of the present invention, reject materials can be maintained at a relatively low level such that the plant can be operated at maximum capacity on a continuous basis.

While there have been described above the principles of this invention in connection with specific apparatus, it is to be clearly understood that this description is made only by way of example and not as a limitation to the scope of the invention.

I claim:

1. In a mineral separation apparatus having a hydraulic classifier provided with an exterior wall, an open bottom sorting column within said exterior wall, means for introducing a swirl of hydraulic medium in the sorting column, said exterior wall providing a quiescent zone below the bottom of said sorting column for collecting a bed of refuse material, and a spigot connected to said quiescent zone for discharging said refuse material therethrough, the improvement which comprises a. a launder section above said exterior wall and sorting column and in communication therewith, said launder section having spaced, upstanding sides, and means for introducing supplemental hydraulic medium, b. first and second weir means in said launder section on opposite sides, respectively, of said exterior wall, said first weir means being higher than said second weir means to provide a hydraulic flow gradient therebetween, feed box means in said launder section separated from said exterior wall by said first weir means whereby hydraulic medium introduced into said feed box means overflows and said first weir means into said sorting column and toward said second weir means, c. a discharge spout on said launder section in communication with said second weir means and the top of said sorting column on the side opposite said first weir means to receive overflow of hydraulic medium from said sorting column and said second weir means, d. the sides of said launder section being of a height to confine flow of the hydraulic medium to and across said sorting column, said weir means and out of said spout, e. valve means operatively associated with said spigot for maintaining the bed level in said quiescent zone, whereby the feed pulp entering said feed box means, overflowing said first and second weir means and also entering said sorting column undergoes conjoint stream and hydraulic classification before being discharged from said discharge spout.

2. The apparatus of claim 1 wherein said launder section has a horizontal bottom superposed said exterior wall and sorting column, said feed box means further having upright sides and ends, said feed box means being disposed on said bottom adjacent one of said ends and extending between said sides, said first weir means being a wall of the feed box and disposed adjacent to one side of said exterior wall, said discharge spout being in the other end of said launder section and communicating with the upper portion of said second weir means, said second weir means being an upright wall at the other end of said launder section on the side of said exterior wall opposite said first weir means, the sides and ends of said launder section extending above said feed box and said weir means.

3. The apparatus of claim 1 wherein said spigot has a refuse port;

said valve means includes a stopper valve movable alternatively into and out of closing engagement with said refuse port, means yieldably urging said stpper valve to closed position;

power means actuable for moving said stopper valve to opened position, a sensing device in communication with said quiescent zone for controlling the operation of said power means in response to a change in the level of the bed in said quiescent zone, said power means including a pressure fluid power cylinder having a piston rod which carries said stopper valve, said power cylinder being fixedly mounted in upright position to a supporting base with said piston rod being vertically reciprocable, said power means further including a pressure fluid connection on said power cylinder for applying pressure fluid against the piston in said power cylinder, thereby retracting said piston rod and opening said stopper valve, an expansible housing mounted on said supporting base and enclosing said power cylinder, said housing including two vertically arranged telescopable parts relatively movable vertically, the upper telescopable part fitting with clearance over the lower part, said upper part having a horizontally disposed closure, an extension secured to said piston rod and said closure projecting through said closure, and said stopper valve being secured to the distal end of said extension.

4. The apparatus of claim 3 including a waste-receiving box on said supporting base surrounding said housing, said waste-receiving box being taller than said housing and positioned to receive waste discharge from said spigot, said waste-receiving box having a waste-discharging outlet in the bottom portion thereof.

5. The apparatus of claim 3 wherein said extension is adjustably secured to said closure, said stopper valve urging means including a spring bearing against said closure thereby urging said stopper valve closed.

6. The apparatus of claim 5 in which said power cylinder is pneumatic and has an exhaust port that opens within said housing whereby exhaust air flows outwardly between said telescopable parts.

7. The apparatus of claim 6 in which the spring that bears against said closure is a helical compression spring surrounding said extension to bear at one end against said cylinder and at the other end against said closure.

8. The apparatus of claim 7 in which said stopper valve has a plumb-bob shape, a stud threaded into said stopper valve end and to the distal end of said extension, lock nuts on said stud for locking both said valve and extension against relative rotation, said extension being adjustably threaded through said closure, a lock nut threaded onto said extension into engagement with said closure for securing said extension and closure against relative rotation.

9. In a mineral separation apparatus having a hydraulic classifier provided with an exterior wall, an open bottom sorting column within said exterior wall, means for introducing a swirl of hydraulic medium in the sorting column, said exterior wall providing an upward rising quiescent zone below the bottom of said sorting column for collecting a bed of refuse material, and a spigot connected to said quiescent zone for discharging said refuse material therethrough, the improvement which comprises a. launder section above said exterior wall and sorting column and in communication therewith, said launder section having spaced, upstanding sides, and means for introducing supplemental hydraulic medium, b. first and second weir means in said launder section on opposite sides, respectively, of said exterior wall, whereby hydraulic medium introduced into said launder section on the side of said first weir means opposite said exterior wall overflows said first weir means into said sorting column and toward said second weir means, c. a discharge outlet on said launder section in direct communication with said second weir means and the top of said sorting column on the side opposite said first weir means to receive and discharge all of the overflow of hydraulic medium from said sorting column and said second weir means, d. the sides of said launder section being of a height to confine flow of the hydraulic medium to and across said sorting column, said weir means and out of said outlet, e. valve means operatively associated with said spigot for maintaining the bed level in said quiescent zone, whereby the feed pulp entering said launder section, overflowing said first and second weir means and also entering said sorting column undergoes conjoint stream and hydraulic classification before being discharged from said discharge outlet.

10. In a mineral separation apparatus having a hydraulic classifier provided with an exterior wall, an open bottom sorting column within said exterior wall, means for introducing a upward rising swirl of hydraulic medium in the sorting column, said exterior wall providing a quiescent zone below the bottom of said sorting column for collecting a bed of refuse material, and a spigot connected to said quiescent zone for discharging said refuse material therethrough, the improvement which comprises a. a launder section above said exterior wall and sorting column and in communication therewith, said launder section having feed and discharge portions on opposite sides, respectively, of said exterior wall, and means for introducing supplemental hydraulic medium b. an outlet for hydraulic medium included in the discharge portion of said launder section, c. means including said hydraulic classifier and said launder section for effecting stream and hyraulic classification of hydraulic medium containing solid particles which is introduced into said feed section, flows into and across said sorting column and out of said outlet, d. valve means associated with said spigot for maintaining the bed level in said quiescent zone, said spigot having a refuse port, e. said valve means including a stopper valve movable alternatively into and out of closing engagement with said refuse port, means yieldably urging said stopper valve to close position, f. power means actuable for moving said stopper valve to opened position, a sensing device in communication with said quiescent zone for controlling the operation of said power means in response to a change in the level of the bed in said quiescent zone, said power means including a pressure fluid power cylinder having a piston rod which carries said stopper valve, said power cylinder being fixedly mounted in upright position to a supporting base with said piston rod being vertically reciprocable, said power means further including a pressure fluid connection on said power cylinder for applying pressure fluid against the piston in said power cylinder, thereby retracting said piston rod and opening said stopper valve, an expansible housing mounted on said supporting base and enclosing said power cylinder, said housing including two vertically arranged telescopable parts relatively movable vertically, the upper telescopable part fitting with clearance over the lower part, said upper part having a horizontally disposed closure, an extension secured to said piston rod and said closure projecting through said closure, and said stopper valve being secured to the distal end of said extension.

* * * * *

UNITED STATES PATENT OFFICE

CERTIFICATE OF CORRECTION

Patent No. 4,033,863 Dated July 5, 1977

Inventor(s) Spencer A. Stone

It is certified that error appears in the above-identified patent and that said Letters Patent are hereby corrected as shown below:

| | |
|---|---|
| Col. 2, line 31, | "bead" should be --bed--. |
| Col. 3, line 8, | after "fail-safe" insert --draw off--. |
| Col. 3, line 20, | "invntion" should be --invention--. |
| Col. 3, line 22, | "anembodiment" should be --an embodiment--. |
| Col. 4, line 32, | "be" should be --by--. |
| Col. 5, line 14, | "ge" should be --be--. |
| Col. 6, line 5, | "agalinst" should be --against--. |
| Col. 6, line 28, | delete "at" between "section" and "18". |
| Col. 6, line 66, | after "compressed" insert --air to the--. |

| | |
|---|---|
| Claim 1, Col. 7, line 44, | delete "a" and substitute therefor --an upward rising--. |
| Claim 1, col. 7, line 62, | delete "and" after "overflows". |
| Claim 3, col. 8, line 35, | "stpper" should be --stopper--. |
| Claim 9, col. 9, line 24, | delete "a" and substitute therefor --an upward rising--. |

UNITED STATES PATENT OFFICE

CERTIFICATE OF CORRECTION

Patent No. 4,033,863 Dated July 5, 1977

Inventor(s) Spencer A. Stone

It is certified that error appears in the above-identified patent and that said Letters Patent are hereby corrected as shown below:

Claim 9, col. 9, lines 25-26 delete "an upward rising".
Claim 10, col. 10, line 7 "a" should be --an--.
Claim 10, col. 10, line 34, "close" should be --closed--.

Signed and Sealed this

Eighth Day of November 1977

[SEAL]

*Attest:*

RUTH C. MASON
*Attesting Officer*

LUTRELLE F. PARKER
*Acting Commissioner of Patents and Trademarks*